United States Patent [19]

Küpper

[11] Patent Number: 4,817,248

[45] Date of Patent: Apr. 4, 1989

[54] VERTICALLY ADJUSTABLE DRAWING FRAME

[75] Inventor: Wilhelm Küpper, Wegberg, Fed. Rep. of Germany

[73] Assignee: Zinser Textilmaschinen GmbH, Ebersbach/Fils, Fed. Rep. of Germany

[21] Appl. No.: 83,776

[22] Filed: Aug. 7, 1987

[30] Foreign Application Priority Data

Aug. 7, 1986 [DE] Fed. Rep. of Germany ..... 3626773

[51] Int. Cl.[4] ..... B65H 54/80; D01H 5/00; F16M 11/26

[52] U.S. Cl. ..... 19/159 R

[58] Field of Search ..... 19/159 R; 38/102.8; 223/68

[56] References Cited

U.S. PATENT DOCUMENTS

| | | | |
|---|---|---|---|
| 410,862 | 9/1889 | Stone | 223/68 |
| 507,079 | 10/1893 | Prest | 19/159 R |
| 535,678 | 3/1895 | Daly | 19/159 R |
| 1,342,190 | 6/1920 | Taylor et al. | 19/159 R |
| 1,484,418 | 2/1924 | Solomon | 38/102.8 |
| 2,695,429 | 11/1954 | Howes et al. | 19/159 R |
| 2,877,505 | 3/1959 | Stephens | 19/159 R |
| 2,976,581 | 3/1961 | Van Deusen | 19/159 R |
| 3,241,196 | 3/1966 | Fornes et al. | 19/159 R |
| 3,316,609 | 5/1967 | Russo | 28/289 |

FOREIGN PATENT DOCUMENTS

| | | |
|---|---|---|
| 7501420 | 1/1975 | Fed. Rep. of Germany . |
| 1598583 | 8/1970 | France . |
| 2158690 | 5/1973 | France . |

*Primary Examiner*—Louis K. Rimrodt
*Attorney, Agent, or Firm*—Herbert Dubno; Andrew Wilford

[57] ABSTRACT

A drawing frame has a housing having an upper part and a lower part telescoping therewith, attachments for securing the parts together at any of a plurality of different vertically offset positions, a turntable in the lower part for supporting a sliver can and for rotating it about an upright axis, and an intake device in the upper part for pulling in and drawing slivers and for depositing the drawn slivers in the can. One of the parts is at least partially within the other part and the one part is formed with a plurality of vertically offset holes. The attachments are bolts engagable through the other part with the holes of the one part. These attachment bolts can simply snap in place, or can actually be screwed into threaded holes in the inner part.

7 Claims, 3 Drawing Sheets

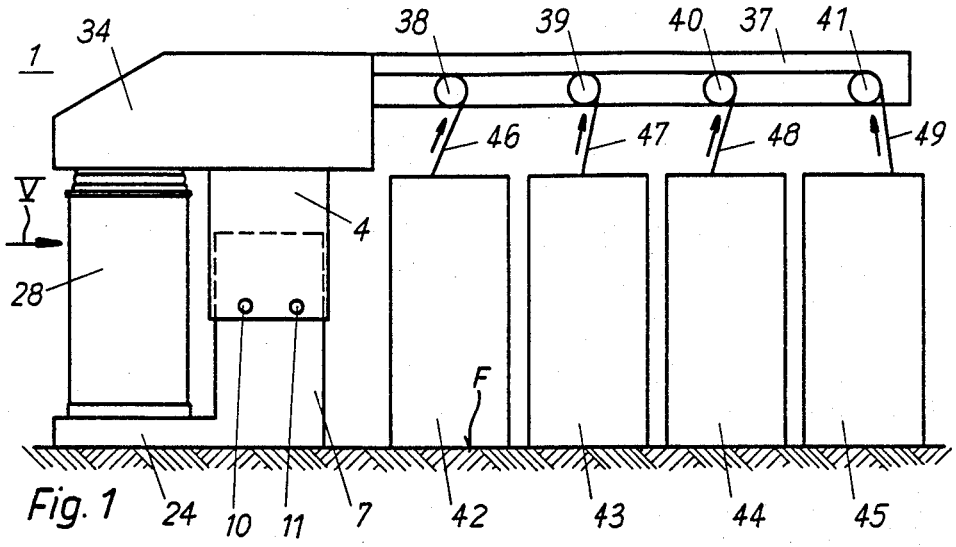
Fig. 1
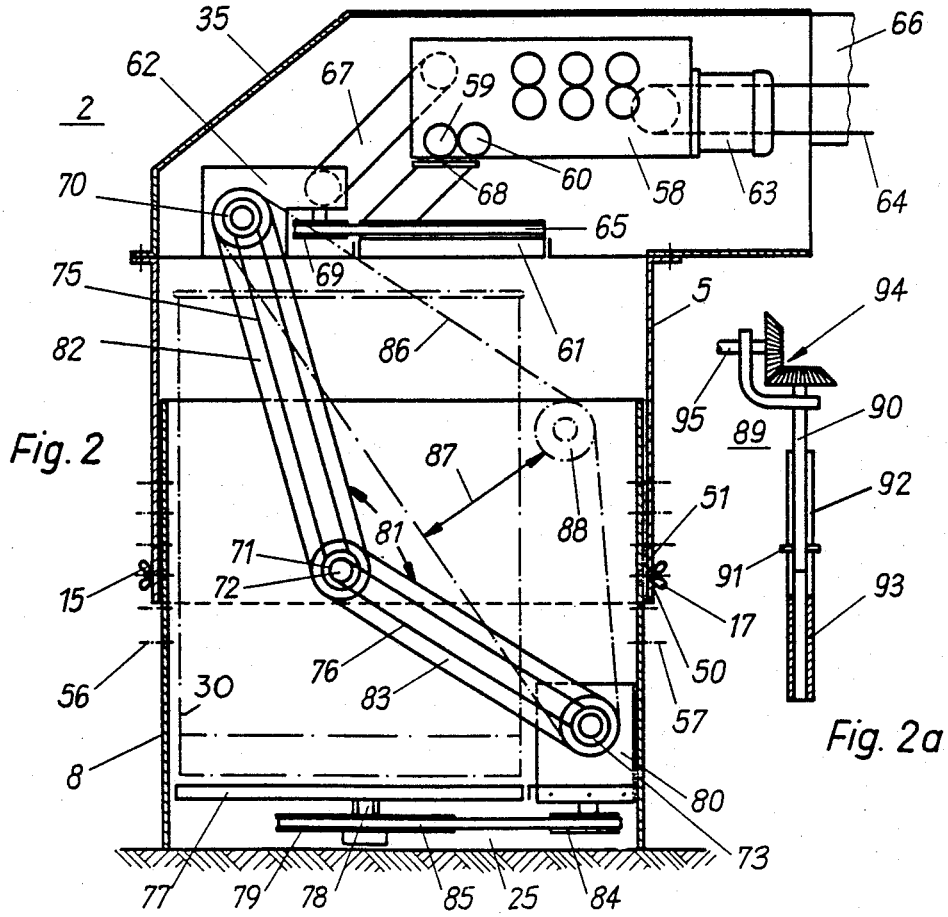
Fig. 2
Fig. 2a

VERTICALLY ADJUSTABLE DRAWING FRAME

FIELD OF THE INVENTION

The present invention relates to a drawing frame. More particularly this invention concerns such a frame usable with sliver containers of different heights.

BACKGROUND OF THE INVENTION

A drawing frame typically has an intake device for drawing in, stretching, calendaring, and/or otherwise treating one or more slivers. The treated slivers are deposited, typically by a coiler, in a can or container that sits underneath the intake device and that is rotated on a turntable about a vertical axis.

Such machines operate at very high speed so that the intake device must be closely juxtaposed with the top of the can into which the treated sliver is deposited. This problem is complicated by the fact that these cans come in several different sizes.

Accordingly it is standard to make the housings of such frames vertically separable so that different spacers can be inserted between the upper and lower parts to accommodate cans of different heights. This solution is cumbersome in practice and requires that a large stock of expensive spacers be manufactured and kept, adaptation of a drawing frame to another can height being very difficult.

OBJECTS OF THE INVENTION

It is therefore an object of the present invention to provide an improved drawing frame.

Another object is the provision of such a drawing frame which overcomes the above-given disadvantages, that is which is relatively easily vertically adjustable.

SUMMARY OF THE INVENTION

A drawing frame according to the invention has a housing having an upper part and a lower part telescoping therewith, attachments for securing the parts together at any of a plurality of different vertically offset positions, a turntable in the lower part for supporting a sliver can and for rotating it about an upright axis, and an intake device in the upper part for pulling in and drawing slivers and for depositing the drawn slivers in the can.

Thus with the system of this invention no extra parts are needed to reset the machine for cans of different height. All that is necessary is to release the attachments, move the two parts into the desired position, and reset them.

According to another feature of this invention one of the parts is at least partially within the other part and the one part is formed with a plurality of vertically offset holes. The attachments are bolts engagable through the other part with the holes of the one part. These attachment bolts can simply snap in place, or can actually be screwed into threaded holes in the inner part.

In accordance with another feature of the invention the upper part houses a drive motor and the frame further has a vertically extensible and contractile transmission coupling the drive motor to the turntable for driving same. This transmission can be a knee-type belt transmission, or a transmission having an upper shaft connected to the drive motor and a lower shaft vertically telescoping with but rotationally connected to the upper shaft and connected to the turntable. It is also within the scope of the invention for the transmission to be a belt transmission having upper and lower pulleys, a belt spanning the pulleys, and a tightening roller maintaining the belt taut.

DESCRIPTION OF THE DRAWING

The above and other objects, features, and advantages will become more apparent from the following, reference being made to the accompanying drawing in which:

FIG. 1 is a side view of a C-shaped drawing frame according to the invention;

FIG. 2*a* is a view of a detail of a variant on the structure of FIG. 2;

FIG. 2 is a large-scale vertical longitudinal section through a portion of a T-shaped frame according to the present invention;

SPECIFIC DESCRIPTION

Figure 5:
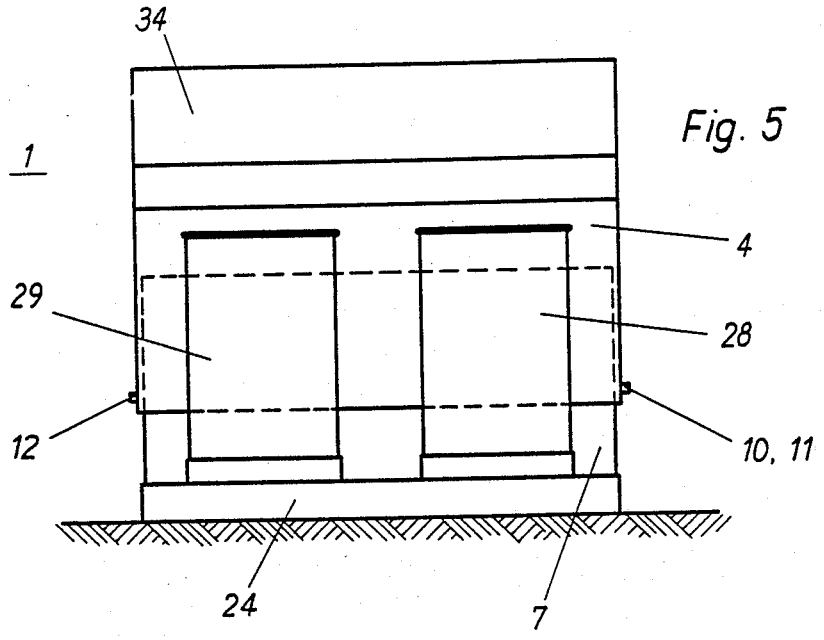
FIG. 5 is a front view taken in the direction of arrow V of the C-frame of FIG. 1.

As seen in FIGS. 1 and 5 a C-shaped drawing frame 1 has a base part 7 sitting on the floor F and, vertically displaceable relative thereto, an upper part 4 supporting at its front end a housing 34 and at its rear end an outrigger arm 37. The upper and lower parts 4 and 7 are of identical rectangular shape but the lower part 7 is slightly smaller than the upper part so it can telescope vertically therein. The two parts are held together at attachments 10, 11, and 12 which as will be described below allow the two parts 4 and 7 to be vertically adjusted and fixed at any of a plurality of different vertical positions relative to each other.

A pair of output cans 28 and 29 centered on and rotatable about vertical axes are supported on a forward support part 24 of the base 7. The height of these cans 28 and 29 determines the vertical spacing set between this foot part 24 and the upper housing 34.

Each side of the outrigger 37 carries four longitudinally spaced intake rollers 38, 39, 40 and 41 associated with respective cans 42 of roving 46, 47, 48, and 49 or the like to be drawn and combined. Thus four slivers are twisted, calendared, and/or spun together and coiled up in each of the cans 28 and 29.

Figure 3:
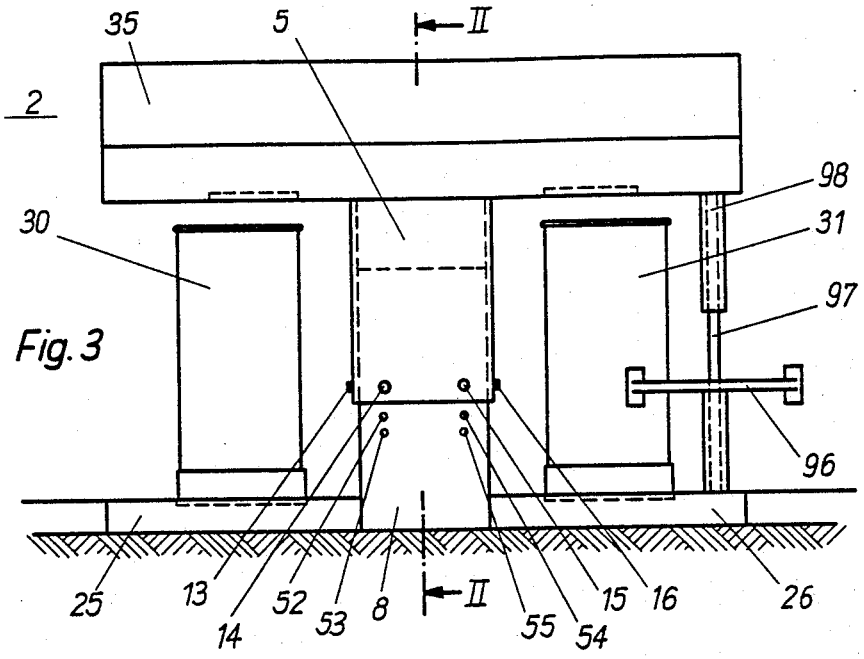
FIG. 3 is a front view of the T-frame of FIG. 2, line II—II indicating the section plane of FIG. 2.
Figure 4:
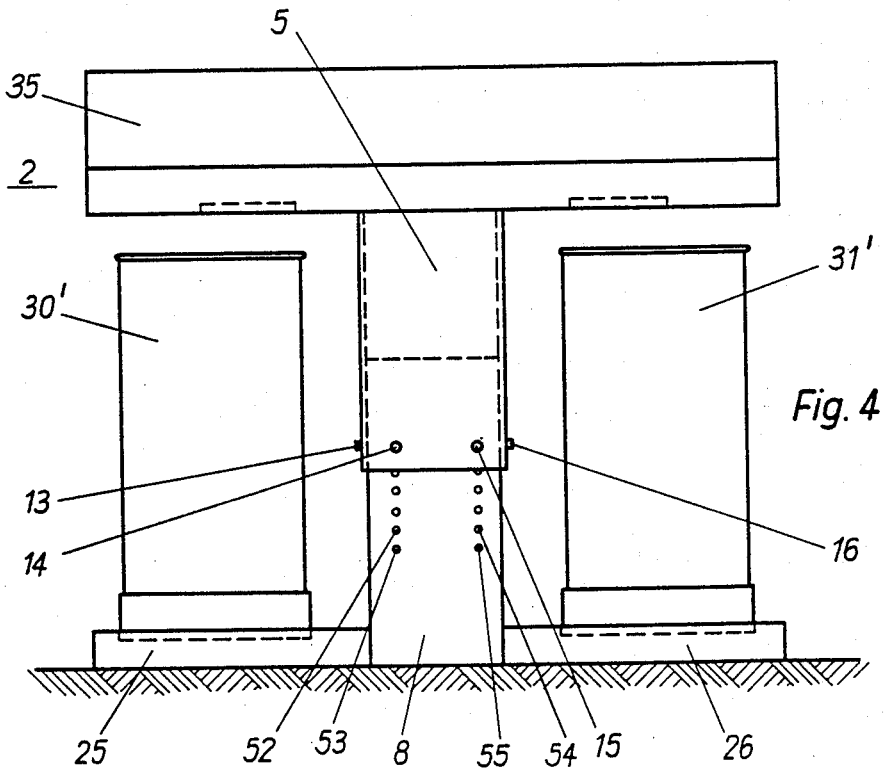
FIG. 4 is a view like FIG. 3 but showing the T-frame set up for taller cans.

FIGS. 2, 3, and 4 show another such drawing frame 2 of T-shape having a central pedestal with an upper part 5 and a lower part 8 comparable to the parts 4 and 7 of the frame 1 of FIGS. 1 and 5. Bolts 13, 14, 15, and 16 and/or wing bolts 17 (FIG. 2) fit through holes 50 in the upper part 5 and are threaded in holes 51–55 arranged at six different levels indicated at 56 and 57 in FIG. 2. Thus this frame 2 is also vertically adjustable so that it can take medium-height cans 30 and 31 as seen in FIG. 3 or tall cans 30' and 31' as shown in FIG. 4. Regardless of height, these cans 30, 31, 30', and 31' sit on foot extensions 25 and 26 of the lower part 8.

As shown in detail of FIG. 2 a single drive motor 63 is provided for the entire frame 2, it being mounted in an upper housing 35 carried on the top part 5 between the cans 30 and 31, the former of whose outline is shown in dot-dash lines in FIG. 2. This motor 63 directly powers two three-pair sets of stretching rollers 58 and two pairs of somewhat lower calendaring rollers 59 and 60, all provided on the respective sides of the upper part 35. In addition a belt 67 connects the motor 63 to a right-angle drive 62 in this part which itself has a pair of vertical-axis pulleys 69 connected by belts 65 to coilers 61 for the drawn and calendared slivers.

Each extension 25 and 26 has a turntable 77 carried for rotation about a vertical axis on a bearing 78 and in turn having a pulley 79 connected by a belt 85 to another pulley 84 carried on a right-angle drive 80 in the lower part 8, it being understood that this drive 80 has two such lower output pulleys 84, one for each turntable 77. The cans 30 and 30 (or 30' and 31') sit on the turntables 77 in the extensions 25 and 26 and can be rotated by these turntables 77 about their central vertical axes.

The upper right-angle drive 62 that is fixed in the upper part 5 is connected to the lower right-angle drive 80 fixed in the lower part 8 by a knee-type belt transmission or coupling indicated generally at 81. This coupling 81 is formed by an upper link 82 having an upper end pivoted on the drive 62 a the horizontal rotation axis of its output pulley 70 and a lower end pivoted at the end of a double pulley 71, 72 on the upper end of a lower link 83 having a lower end pivoted on the lower drive 80 at the horizontal rotation axis of its input pulley 73. A belt 75 is spanned between the upper pulley 70 and one part 71 of the middle pulley 71, 72 and another belt 76 is spanned between the other part 72 of this middle pulley 71, 72 and the lower pulley 73. The ability of this linkage 81 to flex and straighten allows height adjustments to be made without having to worry about the drive for the lower turntables 77.

It is also possible as shown in FIG. 2 in dot-dash lines to provide a single belt 86 spanned between the pulleys 70 and 73 and to keep it taut with a tightening pulley 88 movable transversely of the belt 86 as shown by double-headed arrow 87. As the upper and lower parts 5 and 8 move apart the tightening sheave 88 will move toward the opposite stretch of the belt 86 and vice versa.

FIG. 2*a* also shows a linkage 89 comprised of a tube shaft 93 which can be coaxial with and fixed to the pulley 84 of the drive 80 and which is formed with a slot 92. A solid core shaft 90 telescopes with this shaft 93 but is linked thereto by a diametral pin 91 engaged in the slot 92. A bevel-gear coupling 94 can connect to a shaft 95 replacing the upper pulley 70. Thus as the upper part 5 moves up and down relative to the lower part 8 the two shafts 90 and 93 will telescope while remaining rotationally linked.

FIG. 3 also shows an automatic can-changing device comprised of a changing arm 96 carried on an upright shaft 97 fixed on the base extension 26 and vertically slidable in a guide 98 of the upper housing 35.

Figure 6:
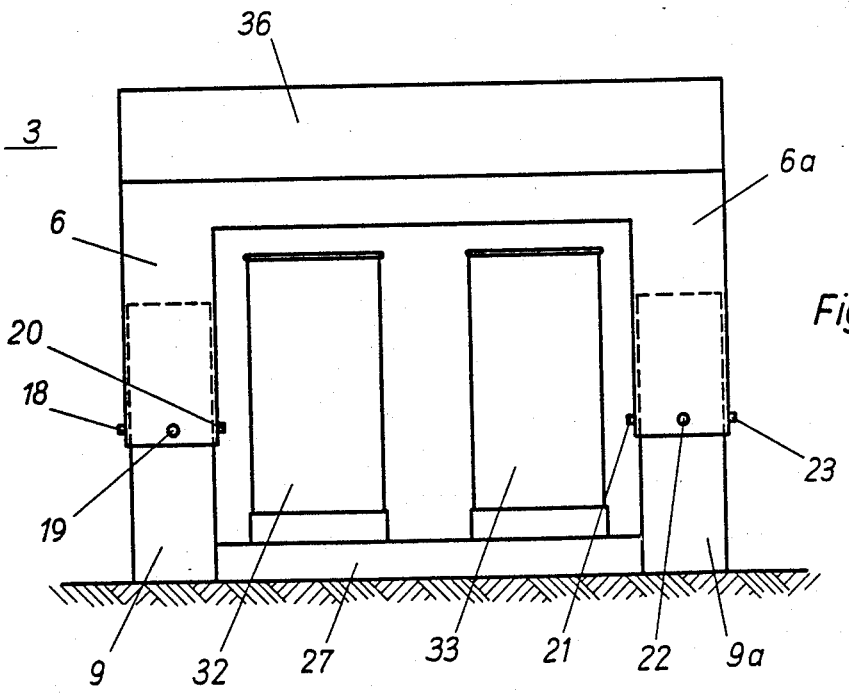
FIG. 6 is a view like FIG. 5 of a portal-type frame according to the present invention.

FIG. 6 shows a portal-type drawing frame 3 having an overhead housing 36 supported on two pedestals, one formed by an upper part 6 and a lower part 9 and the other by an upper part 6*a* and a lower part 9*a*. The parts 6 and 9 are secured together by attachments 18, 19, and 20 and the parts 6*a* and 9*a* by attachments 21, 22, and 23. Two cans 32 and 33 sit on a base 27 between the lower parts 9 and 9*a* and underneath the upper housing 36.

Thus with the system of this invention it is not necessary for the plant to stock a whole series of different housing spacers. Instead all that need be done when changing over from one size to another of output can is release the attachment bolts, reset the height to the desired one, and reset these bolts.

I claim:

1. A drawing frame for depositing filaments in a can, the frame comprising:

a housing having an upper part and a generally stationary lower part telescoping therewith, one of the parts fitting complementarily within the other part;

attachment means for securing the parts together at any of a plurality of different vertically offset positions, whereby the upper part can be set at different heights above the lower part and therefore cans of different heights can be held between the parts;

means in the lower part including a turntable for supporting a filament can and for rotating it about an upright axis; and means in the upper part for pulling in and drawing filaments and for depositing the drawn filaments in the can.

2. The drawing frame defined in claim 1 wherein one of the parts is formed with a plurality of vertically offset holes, the attachment means including bolts engageable through the other part with the holes of the one part.

3. The drawing frame defined in claim 1 wherein the means in the upper part includes a drive motor, the frame further comprising a vertically extensible and contractile transmission coupling the drive motor to the turntable for driving same.

4. The drawing frame defined in claim 3 wherein the transmission is a knee-type belt transmission.

5. The drawing frame defined in claim 3 wherein the transmission has an upper shaft connected to the drive motor and a lower shaft vertically telescoping with but rotationally connected to the upper shaft and connected to the turntable.

6. The drawing frame defined in claim 3 wherein the transmission is a belt transmission having upper and lower pulleys, a belt spanning the pulleys, and a tightening roller maintaining the belt taut.

7. A drawing frame for depositing filaments in a can, the frame comprising:

a housing having an upper part and a generally stationary lower part telescoping therewith, one of the parts fitting complementarily within the other part;

attachment means for securing the parts together at any of a plurality of different vertically offset positions, whereby the upper part can be set at different heights above the lower part and therefore cans of different heights can be held between the parts;

a drive motor fixed in the upper part;

means in the lower part including a turntable for supporting a filament can for rotation about an upright axis;

means including a transmission having an upper end connected to the drive motor and a lower end connected to the turntable and vertically displaceable relative to the lower part for rotating the turntable about the axis; and means in the upper part powered by the drive motor for pulling in and drawing filaments and for depositing the drawn filaments in the can.

* * * * *